United States Patent [19]

Schrempp et al.

[11] 4,063,809

[45] Dec. 20, 1977

[54] PHOTOCONDUCTOR SUPPORT DRUM FOR PHOTOCOPY MACHINE

[75] Inventors: Ernst Schrempp, Norwalk; Henry S. Hazelton, Jr., Fairfield, both of Conn.

[73] Assignee: Pitney-Bowes, Inc., Stamford, Conn.

[21] Appl. No.: 726,899

[22] Filed: Sept. 27, 1976

Related U.S. Application Data

[63] Continuation of Ser. No. 544,193, Jan. 27, 1975, abandoned.

[51] Int. Cl.[2] ..... G03G 15/00

[52] U.S. Cl. ..... 355/3 DR; 355/16

[58] Field of Search ..... 355/3 R, 3 DR, 3 BE, 355/16

[56] References Cited

U.S. PATENT DOCUMENTS

| | | | |
|---|---|---|---|
| 3,584,947 | 6/1971 | Mihalik | 355/16 |
| 3,588,242 | 6/1971 | Berlier et al. | 355/16 |
| 3,706,489 | 12/1972 | Moxness et al. | 355/3 DR |
| 3,826,570 | 7/1974 | Kolibas | 355/16 X |
| 3,891,315 | 6/1975 | Kolibas | 355/8 |

OTHER PUBLICATIONS

Berlier et al., "Automatic Seal Lift and Film Advance Mechanism," IBM Technical Disclosure Bulletin, vol. 17, No. 3; Aug. 1974, pp. 672–673.

*Primary Examiner*—Fred L. Braun

*Attorney, Agent, or Firm*—Martin D. Wittstein; William D. Soltow, Jr.; Albert W. Scribner

[57] ABSTRACT

A photocopy machine is of the type which utilizes a reusable photoconductor and which electrostatically makes copies on plain paper. The drum supports a photoconductor of undeterminate length around the peripheral surface of the drum and includes a supply spool of excess photoconductor mounted within the drum and a take up spool for used photoconductor also mounted within the drum so that the portion of photoconductor positioned around the drum can be periodically replaced. A portion of the drum surface is collapsible and supporting structure is provided at the location where the drum surface collapses to support the photoconductor in a flat plane to permit full frame, flash exposure of the photoconductor. The collapsing of the drum surface and the supporting of the photoconductor in a flat plane are actuated in synchronism with rotation of the drum so that these operations take place when the collapsible portion of the drum is located at an imaging station as determined by the optical path of the photocopy machine.

13 Claims, 5 Drawing Figures

PHOTOCONDUCTOR SUPPORT DRUM FOR PHOTOCOPY MACHINE

This is a continuation, of application Ser. No. 544,193 filed Jan. 27, 1975 now abandoned.

BACKGROUND OF THE INVENTION

In the electrophotographic art, it is well known to use a reusable photoconductor for the production of copies on plain paper, and typically the photoconductor may take one of two forms. In one form, the surface of a drum is suitably coated with a photoconductive material and as the drum rotates within the photocopy machine, an image of an original document is projected onto the photoconductive material by any of a number of well known scanning techniques. The drum rotates past a series of circumferentially arranged operating stations, at the first of which the photoconductive material is uniformly electrostatically charged. The second station is the exposing station where the photoconductive material is exposed to an optical image of the original document, and the photoconductive material is discharged in the light-struck areas in a manner well known in the art. The drum rotates to bring the imaged area of the photoconductive material past a developing station at which developing material is applied to the photoconductive material to render the image visible; both the developing material and several techniques for applying it are well known in the art. Thereafter, the drum rotates to bring the developed image into contact with copy paper at a transfer station to which the copy paper is fed in synchronism with the rotation of the drum, after which the toner image is fixed on the copy paper by well known techniques. The drum continues to rotate to bring the imaged area of the photoconductive material to a cleaning station at which any residual developing material not transferred to the copy paper is cleaned from the photoconductive material. The entire foregoing cycle of operation then repeats itself for as many copies of the document as are desired.

One of the principal disadvantages of the drum type photoconductor is the requirement that the image of the original document be projected onto the photoconductive surface by an optical scanning technique. This necessitates either synchronized movement of the original document and the photoconductor drum through a stationary illumination and optical system or synchronized movement of the photoconductor drum with a movable illumination and optical system while maintaining the original document stationary. Both of these systems are relatively complicated and expensive in terms of hardware and, together with service and maintenance disadvantages, are not desirable. Also, the speed of operation of the copying machine is seriously limited by the time required to scan an original document with the result that many optical scanning type photocopy machines are relatively slow.

These disadvantages are partially overcome by presently known photocopy machines which utilize the so-called full frame or flash exposure imaging technique. Under this technique, a photoconductive material applied to a suitable supporting member is maintained in a flat planar configuration, and an image of the original document is projected onto the photoconductive material by subjecting the document to a very high intensity flash of light for an extremely short interval, much like a typical flash exposure in conventional photography. The light intensity is sufficiently high and the duration sufficiently short that the photoconductive material can be exposed even while it is moving and still result in a clear sharp image. Since this technique is so rapid, all scanning mechanism can be eliminated in a photocopy machine utilizing this technique and the speed of operation considerably increased.

It will be recognized that photoconductive materials suitable for this technique have inherent problems in maintaining the portion being imaged in a flat condition. Obviously, the photoconductive material must be confined within the limits of the photocopy machine and to repetitively make copies at high speeds the photoconductive material must travel in a closed loop path in order to pass through the required operating stations described above repeatedly. Typically, the photoconductive material is suitably carried by a flexible substrate which can be moved along a circuitous path which includes a straight portion which defines the imaging or exposing location of the photoconductive material.

One way to accomplish this is to provide the flexible substrate in the form of an endless belt coated with photoconductive material, the belt passing around suitable guides mounted in the photocopy machine which define both a flat planar section of the belt path for exposing the photoconductive material and the remaining portion of the belt path, which may take any suitable configuration, along which the other processing stations are appropriately spaced. A typical closed loop belt arrangement is shown in U.S. Pat. No. 3,661,452 to Hewes et al. One major difficulty with this arrangement is that it is only practical with selenium as the photoconductive material and precludes the use of other photoconductive materials. This is so for the reason that commercially available inorganic photoconductive materials such as zinc oxide are too slow in adapting to the dark after having been exposed to light to accept a charge within the short time that the belt takes to make one complete excursion along the belt path. The belt path would have to be immensely long in order to store any given segment of the photoconductive material time to adapt to the dark. Organic photoconductive materials are also commercially available, and these materials adapt to the dark and become rechargeable at a very rapid rate, thereby eliminating the drawback of the inorganic photoconductive materials to closed loop belt use. However, organic photoconductive materials are notably weak and subject to abrasion from the usual forms of photoconductor cleaners and accordingly must be replaced considerably more frequently than inorganic photoconductors and far more frequently than selenium photoconductors. Again, therefore in order to provide a photoconductive element which will yield a commercially acceptable number of exposures, a substantially long length of photoconductive material must be provided; far in excess of that which could be provided in a closed loop belt configuration.

One technique for utilizing a long indefinite length of photoconductive material without encountering the severe storage problem of a long closed loop belt is shown in U.S. Pat. No. 3,588,242 to Berlier. A rotatably mounted hollow drum has a supply spool of organic photoconductor mounted therein as well as a take up spool and the photoconductor passes from the supply spool through a slit in the drum surface and thence around the peripheral surface of the drum and back through the slit to the take-up spool. In operation, the drum rotates and copies are made exactly as described above with respect to the selenium coated photoconductor drum. When the segment of photoconductive material around the drum becomes unusuable for the production of satisfactory copies, a drive mechanism operates to rotate the take-up spool sufficiently to place a fresh segment of photoconductor around the drum. When the entire photoconductor is used, it is replaced with a fresh supply spool. It will be apparent that this technique requires an optical scan imaging technique of one of the types described above and therefore inherently possesses all of the disadvantages previously described which are attendant to this technique.

Earlier attempts to avoid both the optical scanning technique and the belt photoconductor arrangement and the disadvantages and limitations attendant thereto are illustrated by U.S. Pat. Nos. 3,584,947 and 3,706,489. In the earlier patent, a plurality of individual photoconductive plates are attached to a framework which is carried by a rotatably mounted drum. As the drum rotates, the framework operates through a linkage mechanism to maintain the photoconductive plate in a planar configuration so as to permit full frame flash exposure, after which the framework operates to cause the photoconductive plate to lie upon and conform to the curvature of the rotating drum to facilitate the operation of the other functions of the copying machine. It will be apparent that the enormous complexity of the framework and the actuating mechanism therefor, as well as the limited life of the photoconductive plates, present serious drawbacks to a copying machine of this type becoming commercially successful.

In the later patent a supply roll of a web photoconductor and a take-up spool are both mounted inside of a rotatably mounted drum, and the photoconductor passes over a flat bed or imaging plate mounted on the drum. In operation, the portion of the photoconductor overlying the flat plate is imaged by flash exposure, and the web is then moved to bring the exposed portion to a position where it lies on a curved portion of the drum so that the other above described operations of a copying cycle can be performed during rotation of the drum. In moving the web as just described, a fresh portion is brought into position across the flat bed for the next copying cycle. It will be apparent that this arrangement presents a very inefficient use of the photoconductor web since each segment which is exposed is used once to make a copy and is then wound on the take-up spool, except for the case of making multiple copies of the same document. Even then, the photoconductor cannot be re-exposed for the same document on the same section of photoconductor, and multiple copies will become progressively poorer in quality due to gradual degradation of the charge image on the photoconductor with each developing and transfer operation.

It is apparent from the foregoing that, prior to the present invention, there is no commercially satisfactory arrangement for handling a web photoconductor which avoids all the disadvantages of prior art techniques and yet retains the benefits found individually in each technique.

SUMMARY OF THE INVENTION

The present invention relates generally to electrophotographic copying machines, and more particularly to a technique for handling a web type photoconductor of indefinite length for making copies on plain paper.

In its broader aspects, the present invention is embodied in a photocopy machine in which a hollow drum is rotatably mounted, and a plurality of operating stations including charging, exposing developing, transferring and clearing are mounted at spaced locations around the periphery of the drum, so that a segment of the drum passes each station successively during rotation of the drum. The drum supports a photoconductor which is preferably formed as a web of indefinite length wound on a supply spool mounted within the drum, with the photoconductor passing around the drum and being connected to a take-up spool also mounted within the drum. A portion of the drum periphery is mounted to be collapsible to a position within the drum, and a movable photoconductor supporting mechanism normally stored within the drum is operable to extend beyond the periphery of the drum when the collapsible portion is within the drum, the supporting mechanism being operable to support the photoconductor in a flat planar configuration when it is extended beyond the drum surface to facilitate full frame flash exposure.

The present invention also includes a means for incrementally advancing the photoconductor web around the drum with each revolution of the drum so that fresh photoconductor web is supplied to the peripheral surface of the drum approximately the same rate at which the photoconductor is used to the point where it no longer produces satisfactory copies.

In some of its more limited aspects, the present invention includes a circular hollow drum having a pair of pivotally mounted doors which normally define a portion of the drum surface, but which can pivot inwardly to a position when the drum surface is collapsed and does not support the photoconductor passing around the drum. A pair of photoconductor supporting members are mounted within the drum and operatively with the doors so that as the latter pivot inwardly of the drum, the supporting members pivot outwardly so that the photoconductor is at all times supported, but a portion of the photoconductor overlying the doors is gradually changed from a curved configuration to a planar configuration to permit flash exposure thereof.

Preferably the pivotal movement of the doors and the photoconductor supporting mechanism takes place while the drum is rotating so that no time is lost in the copying cycle during the transformation of the photoconductor segment from curved to planar and back to curved. To achieve this, the doors are formed of segments to define slots therebetween, and the movable supporting mechanism is a plurality of rollers which project through the slots to support the photoconductor when the doors are in the collapsed position.

Having briefly discussed the general nature of the present invention, it is a principal but general object thereof to provide an improved photoconductor handling apparatus for a photocopy machine which avoids the disadvantages and limitations of prior art photoconductor handling apparatus without loss of the attendant advantages of such prior art apparatus.

It is another more specific object of the present invention to provide a web photoconductor handling apparatus for a photocopy machine in which a portion of the photoconductor passing around a support drum is in flat planar configuration for flash exposure imaging and in curved configuration during other operations in a copying cycle, and is changed from one to the other.

It is still another object of the present invention to provide a web photoconductor handling apparatus in which the change in shape of the photoconductor occurs gradually without any loss of photoconductor support.

It is yet another object of the present invention to provide a web photoconductor handling apparatus in which the change in shape of the photoconductor occurs while the drum is rotating and in synchronism with the drum rotation so that the photoconductor is in the flat configuration only for the short interval of time required for the flash exposure.

It is a still further object of the present invention to provide a web photoconductor handling apparatus in which a supply of the photoconductor is stored within the supporting drum and the photoconductor is incrementally fed around the drum to provide fresh photoconductor at a rate at which it is used.

It is another object of the present invention to provide a web photoconductor handling apparatus which is relatively simple and inexpensive to manufacture, is reliable in operation and requires substantially little maintenance.

These and other objects, features and advantages will be more apparent from an understanding of the following detailed description of a presently preferred embodiment of the present invention when considered in conjunction with the accompanying drawings in which.

DETAILED DESCRIPTION OF A PREFERRED EMBODIMENT

Figure 1:
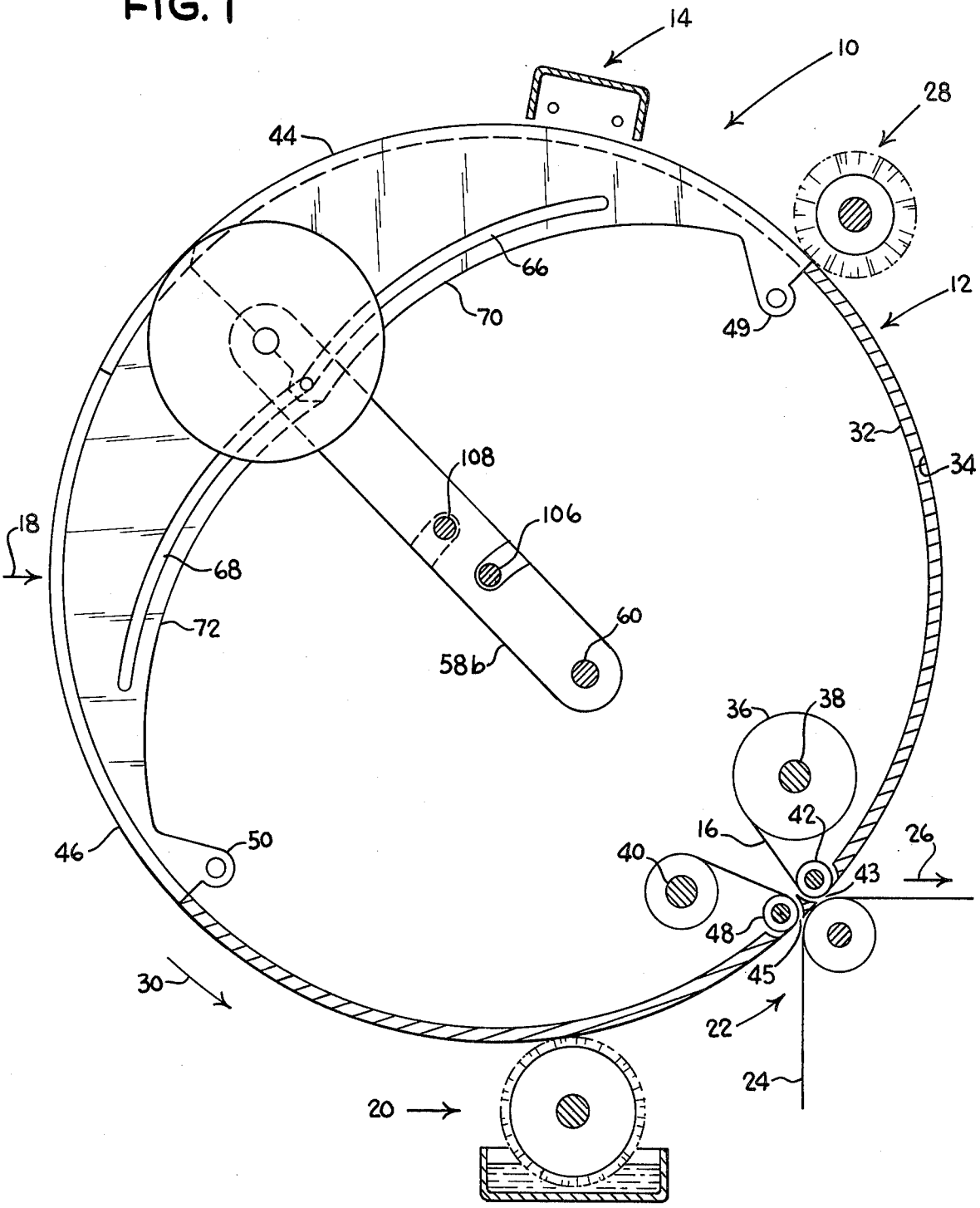
FIG. 1 is an axial sectional and partial schematic view of a photoconductor handling apparatus and photocopy machine in accordance with the present invention.

Referring now to the drawings and particularly to FIG. 1, the essential components of an electrophotographic copying machine are generally designated by the numeral 10, and include a hollow cylindrical drum generally designated by the numeral 12. The drum is suitably supported in a frame of the copying machine, the details of the frame and the manner of mounting the drum therein not being shown in the drawings nor further described since neither is significant to the present invention and both are well known in the art. A plurality of operating components are also suitably mounted in the frame of the copying machine at appropriate spaced locations around the periphery of the drum 12, and again the manner in which these components are mounted, except to the extent specifically explained hereinafter, is not significant to the invention. These components include an electrostatic charger generally designated by the numeral 14 of any suitable type by means of which a uniform electrostatic charge is applied to the photosensitive surface of a web photoconductor 16 which passes completely around the peripheral surface of the drum 12 and which will be more fully described hereinbelow. The arrow designated by the numeral 18 indicates the optical axis of an exposure station at which, as more fully described below in connection with the description of the mechanism for changing the configuration of the photoconductor web from curved to flat and back to curved, an image of the document being copied is projected onto the photoconductor by any suitable optical system including a source of high intensity flash illumination and a focusing lens. At a farther location there is a developing apparatus generally designated by the numeral 20 which applies toner material to the photoconductor to cause the latent electrostatic image on the photoconductor to become visible. The developing apparatus 20 may be either of the magnetic brush type or the cascade types (the former being schematically indicated), both being well known in the art and therefore not necessary of further description. At another location there is a transfer apparatus generally designated by the numeral 22 at which copy paper is suitably fed along a path indicated by the numeral 24 so as to bring the copy paper into contact with the toner image on the photoconductor so that the toner image can be transferred from the photoconductor to the copy paper, this typically being accomplished by creating an electrostatic field in which the toner particles are repulsed from the photoconductor and attracted to the copy paper. The copy paper with the transferred toner image thereon is fed in the direction of the arrow 26 to any suitable fusing device in which the toner image is fused to the copier paper to make it permanent. Spaced further from the transfer apparatus 22 is a cleaning apparatus generally designated by the numeral 28 which cleans any residual toner material from the photoconductor which may not have been transferred to the copy paper. It will be apparent from the foregoing that, as the drum 12 rotates in a counterclockwise direction as indicated by the arrow 30, any given portion of the photoconductor will be moved past the charging apparatus, the exposure area, the developing apparatus, the transfer apparatus and the aligning apparatus successively so that all of the necessary operations of a normal copying cycle are performed in sequence.

Still referring to FIG. 1, it will be seen that the drum 12 is formed as a hollow cylinder having a circumferential wall 32 which defines a peripheral surface 34 against which the photoconductor 16 lies. The photoconductor 16 is formed as a web of idefinite length and a relatively large supply 36 of the photoconductor 16 is wound on a spool or core 38 which is suitably mounted within the drum. A take-up spool 40 is also mounted within the drum adjacent the supply spool and is driven by a mechanism to be more fully described below. The photoconductor 16 extends from the supply 36 around a guide roller 42, through a slit 43 formed in the wall 32 of the drum 12, around the periphery of the drum and back through another slit 45 in the drum wall and over another guide roller 48, finally terminating at and being connected to the take-up spool 40. By driving the take-up spool in the manner described below, fresh photoconductor material can be drawn from the supply 36 and used photoconductor is stored on the take-up spool.

Figure 2:
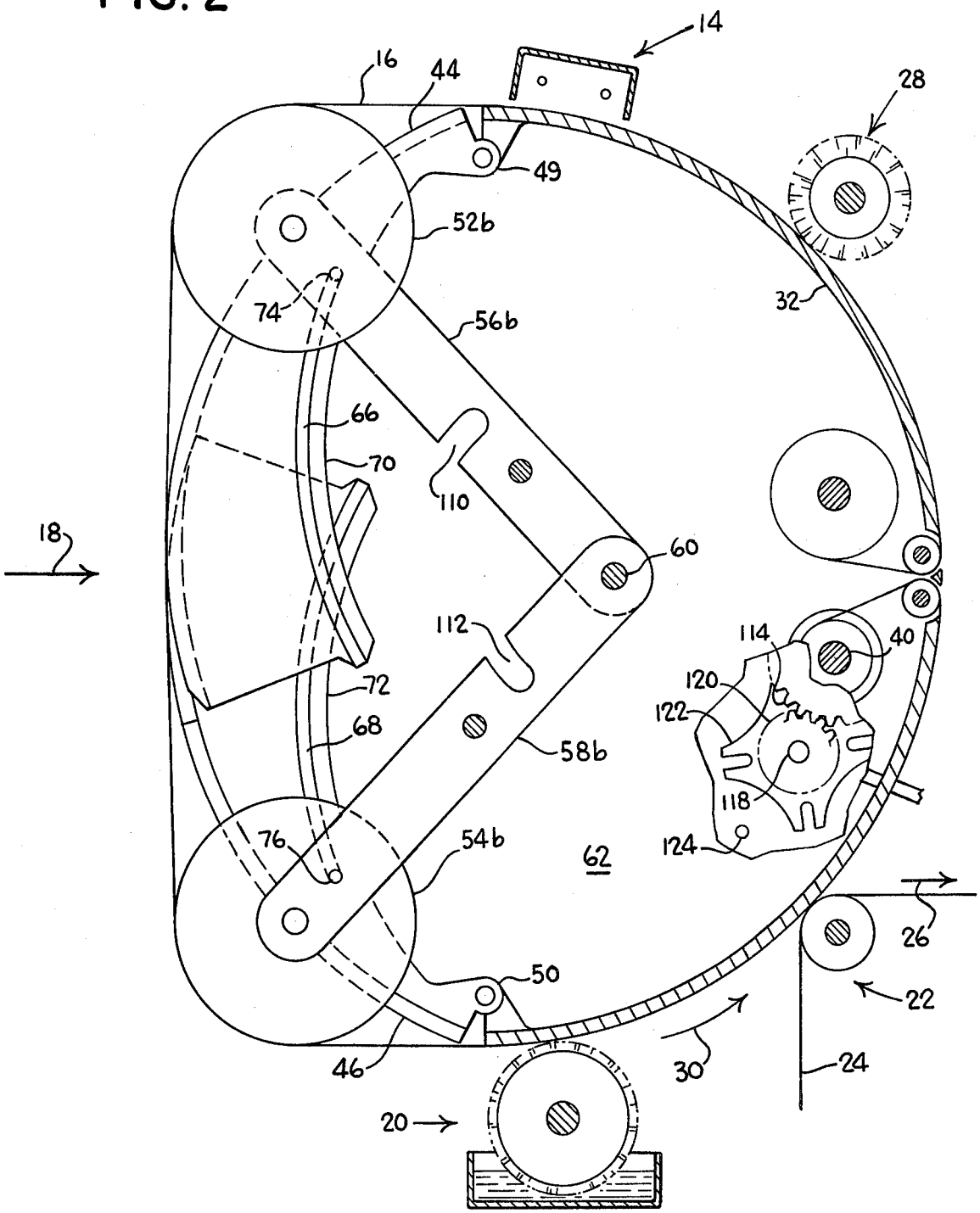
FIG. 2 is a view similar to FIG. 1 but showing the photoconductor supporting parts in the positions occupied when a portion of the photoconductor is flat during exposure thereof.

Referring now to FIGS. 1 and 2, it will be seen that the photoconductor 16 lies upon and conforms to the curvature of the drum 12 when the drum is in one position of rotation with respect to the other operating components of the copying machine as shown in FIG. 1, but a portion of the photoconductor is maintained in a flat planar condition and out of contact with the drum surface in the exposure area 18 of the copying machine when the drum 12 is in another position of rotation as seen in FIG. 2. Thus, as is explained in more detail below, as the drum rotates, a given segment of the photoconductor undergoes a change in shape from curved to flat and back to curved, and this occurs while the drum 12 is in motion.

Generally, this is accomplished by constructing a portion of the drum wall 32 as a pair of collapsible doors 44 and 46, each of which is pivotally mounted on the drum by means of the pivotal connections 49 and 50, respectively. When the doors 44 and 46 are pivoted inwardly by mechanism to be fully described below, the drum wall changes from circular to non-circular and the portion of the photoconductor overlying the doors 44 and 46 is no longer supported thereby. This portion of the photoconductor is, however, as seen in FIG. 2, supported in a flat planar configuration by a support means contained within the drum and constituted generally by guide rollers 52 and 54 carried by arms 56 and 58 respectively, the latter being pivotally mounted on a shaft 60 which extends the length of the drum 12 and is suitably mounted in the drum such as by being supported by the side walls 62 and 64 of the drum. It will be apparent thus far that as the drum rotates from the position shown in FIG. 1 to that shown in FIG. 2, the doors 44 and 46 collapse and the guide rollers 52 and 54 and supporting arms 56 and 58 extend from the position of these parts shown in FIG. 1 to the positions of these parts shown in FIG. 2, the portion of the photoconductor overlying the doors will be supported in the flat position shown in FIG. 2 and extending for a predetermined length on each side of the optical axis indicated by the arrow 18. It is therefore possible to expose that portion of the photoconductor by means of full frame high intensity flash exposure.

Figure 3:
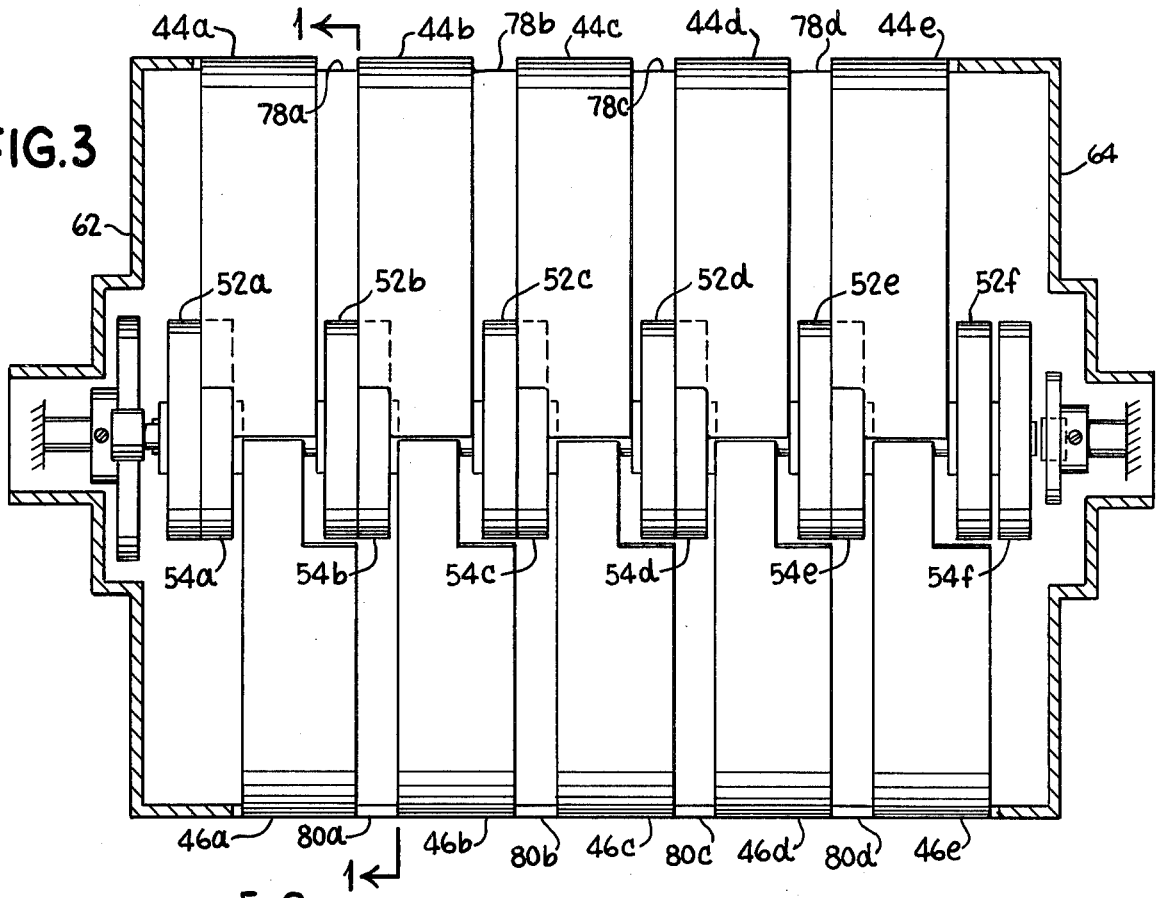
FIG. 3 is a top plan view across the exposure axis of the photoconductor handling apparatus as shown in FIG. 1.

The specific mechanism for accomplishing the foregoing will now be described with reference to FIGS. 1 through 5. As best seen in FIG. 3, each of the doors 44 and 46 is constructed as a plurality of door segments 44*a*–44*e* and 46*a*–46*e* respectively with each of the segments being pivotally connected to the drum at respective pivot points corresponding to the pivots 49 and 50 shown in FIG. 1. Each door segment is provided with an arcuate slot 66 and 68 which extends from the free end of each door segment toward the pivoted end thereof, the slots being located adjacent the inner edge 70 and 72 of each door segment. The slots are adapted to accommodate pins 74 and 76 respectively mounted on each of the arms 56*a*–56*f* and 58*a*–58*f* with the result that as the arms oscillate about the shaft 60 from the aligned position shown in FIG. 1 to the extended position shown in FIG. 2 and back, the door segments are pulled inwardly and pushed outwardly respectively through the action of the pins 74 and 76 moving in their respective slots 66 and 68 in all of the door segments.

Figure 4:
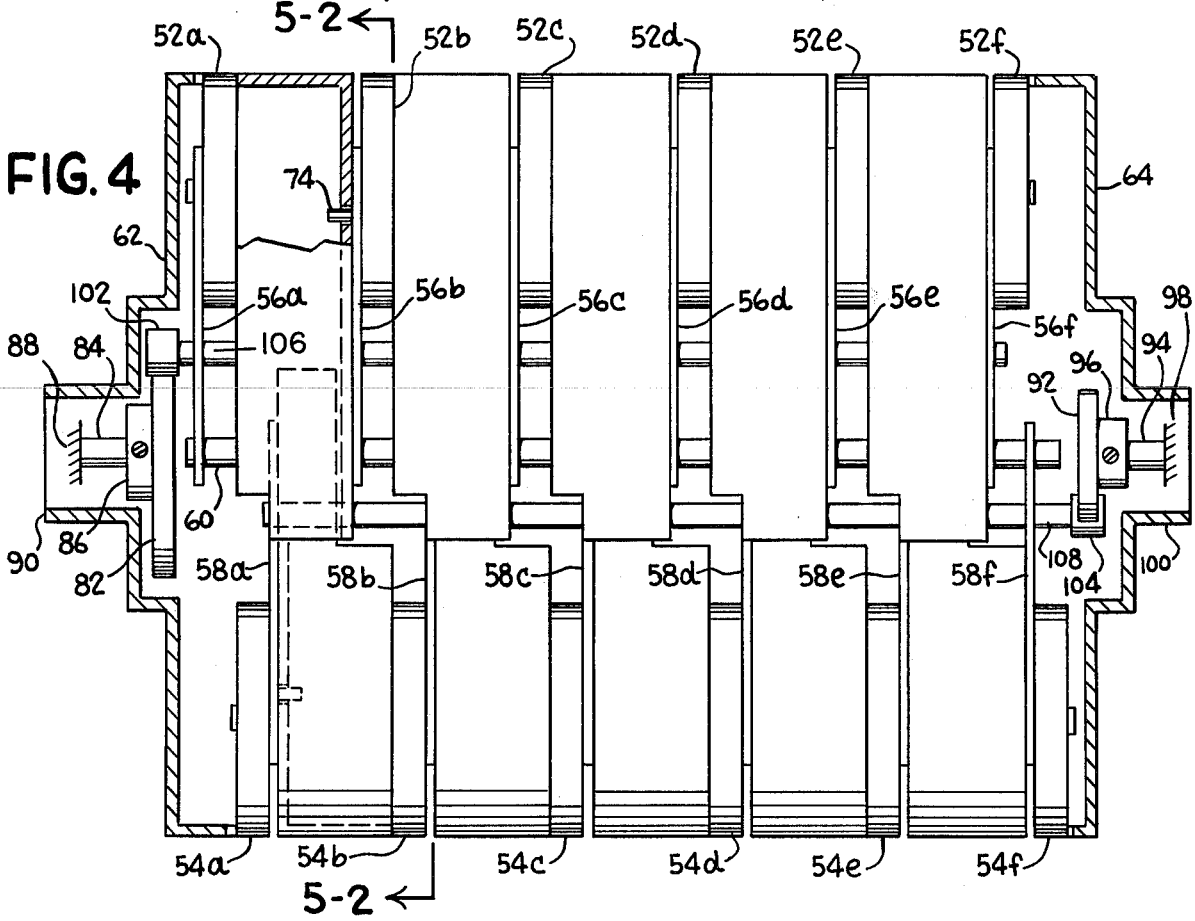
FIG. 4 is a top plan view across the exposure axis of the photoconductor handling apparatus as shown in FIG. 2.
Figure 5:
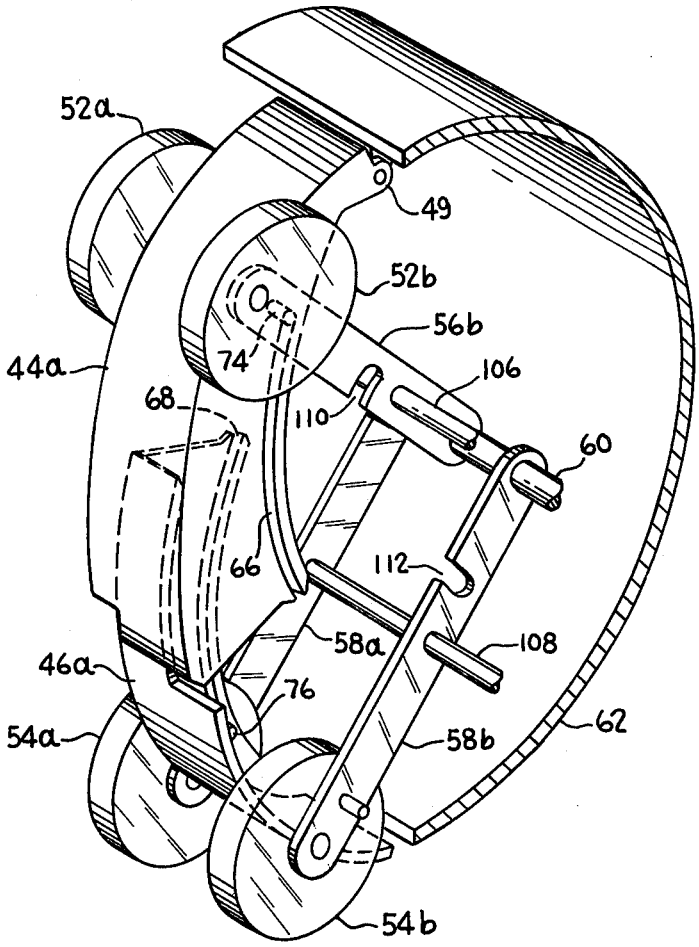
FIG. 5 is a fragmentary perspective view of a portion of the photoconductor handling apparatus as shown in FIG. 2.

It should be noted that all of the door segments 44*a*–44*e* and 46*a*–46*e* are separated by slots 78*a*–78*d* and 80*a*–80*d* respectively, these slots being for the purpose of accommodating the guide rollers 52 and 54 between the door segment when the latter are in their collapsed position. Thus, as best seen in FIG. 4, there are six guide rollers 52*a*–52*f* and 54*a*–54*f* carried by a corresponding member of arms 56*a*–56*f* and 58*a*–58*f* all pivotally mounted on the shaft 60. As best seen in FIG. 3, the guide rollers 52*a*–52*e* are offset relative to the guide rollers 54*a*–54*e* in the same manner that the slots 78*a*–78*d* are offset from the slots 80*a*–80*d* so that all of the guide rollers and all of the supporting arms can be aligned in the axial direction of the drum when the parts are in their FIG. 1 position, and the guide rollers can extend through their respectively adjacent slots when the guide rollers and supporting arms are moving to their FIG. 2 positions.

The supporting arms and guide rollers are moved between their extreme positions by means of a cam actuated assembly which is mounted within the drum 12 is responsive to rotation of the drum to cause movement of the supporting arms and guide rollers. Thus, with reference to FIGS. 3, 4 and 5, it will be seen that a stationary cam 82 is mounted on a shaft 84 by means of a collar 86, the cam 82 being held stationary with respect to the drum 12 by having the shaft 84 fixedly connected in any suitable manner to the frame of the copying machine in which the drum is mounted. This connection is schematically indicated by the numeral 88 and is actually located beyond the tubular extension 90 of the side wall 62 of the drum 12 which extension serves conveniently as a means of rotatably mounting the drum. A similar arrangement is found on the opposite side of the drum with a cam 92, shaft 94, collar 96, numeral 98 indicating a fixed connection of the shaft 94 to the copying machine frame and tubular extension 100 of the drum sidewall 64. Both of the cams 82 and 92 are located so as to be out of interference with the shaft 60 which is mounted in the drum sidewalls so as to rotate therewith.

Each cam 82 and 92 has an associated cam follower 102 and 104 respectively which is adapted to move around its associated cam upon rotation of the drum 12. The cam follower 102 is mounted on a shaft 106 which extends through all of the supporting arms 56*a*–56*f*, and the cam follower 104 is mounted on a shaft 108 which extends through all of the supporting arms 58*a*–58*f*. All of the supporting arms 56*a*–56*f* are provided with appropriately spaced notches 110 and 112 respectively into which the shafts 108 and 106 respectively move when the supporting arms and guide rollers are all aligned when these parts are in their normal withdrawn positions. As will be seen more clearly in the description of a cycle of operation, rotation of the drum about the stationary cams 82 and 92 causes the supporting arms and guide rollers and door segments to move from their normal positions to their extended and collapsed positions and back to their normal positions during each revolution of the drum.

The apparatus of the present invention is provided with a mechanism for continuously indexing the photoconductor 16 around the drum as the drum rotates so that fresh photoconductor is supplied to the marking surface of the drum at a rate coordinated with the rate at which the photoconductor begins to deterioriate from use so that the photoconductor passing around the drum always makes acceptable quality copies. To accomplish this, a mechanism is employed which is quite similar to that fully described and shown in copending applications Ser. No. 449,033 filed on Mar. 7, 1974, now U.S. Pat. No. 3,877,806, and Ser. No. 521,115 filed on Nov. 5, 1974, now U.S. Pat. No. 3,984,241, and owned by the assignee of this application. With reference to FIG. 2, this mechanism comprises a gear 114 fixed to the take-up spool 40 such as by having a shaft extending from the take-up spool through the side wall 62 of the drum so that the gear 114 is on the outside of the drum wall. Any suitable bracket not shown is mounted on the drum wall 90 support a shaft 118 for rotation, and a driving gear 120 is mounted on one end of the shaft 118.

A Geneva wheel 122 is mounted on the other end of the shaft 118 in position to be engaged by the end of a pin 124 which is fixed to the frame of the photocopy machine in any suitable manner. In a manner well known in the art, each time the Geneva wheel passes the pin 124, it is rotated through a 90° arc, which in turn rotates the gears 120 and 114 to cause the take-up spool 40 to wind a small increment of photoconductor onto the take-up spool. By maintaining tension on the supply spool by any suitable means, the photoconductor is always maintained taut around the surface of the drum.

In a typical cycle of operation of the apparatus described above, when it is desired to make a copy and the copying machine is energized, the drum 12 will normally be in a position where that portion of the photoconductor overlying the door segments has not passed under the charging device 14, so that upon initial rotation of the drum in the direction of the arrow 30 shown in FIG. 1, the portion of the photoconductor overlying the door segments passes under the charging device 14 so that a uniform electrostatic charge is applied to the photoconductor surface. As the drum approaches the position shown in FIG. 1, the cam followers 102 and 104 approach the lobes on the cams 82 and 92 respectively which cause the shafts 106 and 108 respectively to commence movement in a separting direction, the movement of the shafts 106 and 108 causing a corresponding separating movement of the supporting arms 56*a*–56*f* and 58*a*–58*f* respectively. As the supporting arms move toward the separated position shown in FIG. 2, the pins 74 and 76 of each supporting arm which are engaged in the slots 66 and 68 of each door segments 44*a*–44*e* and 46*a*–46*e* respectively draw the door segments inwardly toward their collapsed positions. Thus the extending movement of the guide rollers 52*a*–52*f* and 54*a*–54*f* and the collapsing movement of the door segments 44*a*–44*e* and 46*a*–46*e* take place simultaneously with the result that the photoconductor is uniformly supported across its width at all times so that the photoconductor is maintained under proper tension during the change in shape from circular to flat. The shape of the cams 82 and 92 is such that the supporting arms and guide rollers reach their full extended position just prior to the drum reaching the rotary position shown in FIG. 2 so that when the flat portion of the photoconductor is exactly perpendicular to the optical axis 18 of the copying machine, the photoconductor can then be exposed to the short duration, high illumination intensity full frame exposure of the optical image of the document being copied. When the drum rotates past the above mentioned position, the supporting arms and guide rollers are retracted, the door segments extended by a reversal of the operation described above. In order to accomplish this, the cams 82 and 92 may be formed with internal grooves within which the cam followers 102 and 104 ride to urge the cam followers in both directions of operation. Alternatively, suitable springs may be provided as desired to normally urge the movable parts toward the positions shown in FIG. 1 with the cams functioning to move the parts to the FIG. 2 positions against the urging of the springs. The specific manner of accomplishing this is not important to a full understanding of the present invention; it is only important to note that the parts must be returned to their normal positions prior to the exposed portion of the photoconductor reaching the developing mechanism 20.

After the drum 12 has rotated to the point where the supporting arms and guide rollers have been fully retracted and the door segments returned to their normal position of supporting the photoconductor in a circular configuration, the remainder of the copying cycle takes place in the conventional manner. The latent image on the photoconductor is developed by the developing apparatus 20 and the developed image is transferred to plain paper by the transfer device 22. Any residual developing material on the photoconductor will be removed by the cleaning brush 28, after which the photoconductor is in condition for another cycle of operation. It will be noted that each time the drum makes one revolution, the photoconductor indexing mechanism will have operated as described to index the photoconductor by turning the take-up spool through a small increment and thereby withdraw fresh photoconductor from the supply spool by the same amount.

What is claimed is:

1. In a photocopy machine which utilizes a web photoconductor for making copies of a document by exposing a portion of the photoconductor to a full frame, short duration, high illumination intensity image of the document to produce an electrostatic latent image of the document on the photoconductor which is developed by the application of developer material which in turn is transferred to copy paper, apparatus for handling the photoconductor web comprising:

a. a hollow drum mounted in the photocopy machine for rotation therein to bring successive portions of the drum surface into operative relationship with copying instrumentalities arranged in a substantially circular path around the drum surface;

b. a single photoconductor web supported by and extending around the drum surface;

c. supply means and takeup means for said photoconductor web mounted for rotation within said drum;

d. slit means formed in said drum closely spaced relationship through which said photoconductor extends from said supply means to said drum surface and from said drum surface to said take-up means after said photoconductor web passes around said drum surface;

e. first means movably mounted on said drum and normally positioned to define a portion of said drum surface and to maintain said photoconductor web in a circular configuration, said first means being movable to a collapsed position in which said portion of said drum surface is non-circular;

f. second means movably mounted within said drum and normally positioned to be out of supporting relationship with said photoconductor web, said second means being movable to an extended position in which said second means supports a portion of said photoconductor web in a flat planar configuration, and g. actuating means operable to move said first and second means simultaneously from said normal positions to said collapsed and extended positions respectively when said drum reaches a predetermined point of rotation; whereby at said point of rotation said flat portion of said photoconductor web can be exposed to a full frame, short duration, high illumination intensity image of a document.

2. Apparatus as set forth in claim 1 wherein said actuating means comprises means for causing said simultaneous movement of said first and second means while said drum is rotating.

3. Apparatus as set forth in claim 2 wherein said means for causing said simultaneous movement of said first and second means while said drum is rotating comprises means operable in response to rotation of said drum whereby the arrival of said first and second means at said collapsed and extended positions respectively is synchronized with the arrival of said drum at said point of rotation.

4. Apparatus as set forth in claim 1 wherein said actuating means comprises means operable to move said first and second means simultaneously from said normal positions to said collapsed and extended positions respectively and back to said normal positions while said drum is rotating within a predetermined arc of rotation.

5. Apparatus as set forth in claim 4 wherein said means for causing said simultaneous movement of said first and second means from said normal positions to said collapsed and extended positions respectively and back to said normal positions while said drum is rotating within said predetermined arc comprises means operable in response to rotation of said drum whereby said simultaneous movements of said first and second means away from and to said normal positions are synchronized with rotation of said drum to cause said movements to occur in precise timed relationship with said rotation of said drum.

6. Apparatus for changing the shape of a thin web-like flexible member while said member is rotating in a substantially circular path comprising:

a. primary means for supporting said web-like member in a substantially circular configuration and for rotating said member about a central axis;
b. supply means and take-up means for said web-like member mounted for rotation within said primary supporting means;
c. slit means formed in said primary supporting means in closely spaced relationship through which said web-like member extends from said supply means to said take-up means after said web-like member passes around said primary supporting means;
d. means for collapsing a portion of said primary supporting means so as to be out of supporting relationship with said web-like member;
e. auxiliary supporting means disposed within said primary supporting means at the locations where said portion of said primary supporting means collapses, said auxiliary supporting means normally being disposed in a position where said auxiliary supporting means is out of supporting relationship with said web-like member;
f. means for moving said auxiliary supporting means to a position where said auxiliary supporting means is in supporting relationship with said web-like member so as to support said web-like member in a flat configuration when said portion of said primary supporting means is collapsed, and
g. actuating means for actuating said means for collapsing said portion of said primary supporting means and said means for moving said auxiliary supporting means in timed relationship with each other and with rotation of said primary supporting means, whereby said web-like member is maintained in a substantially taut condition throughout the change in shape of said web-like member and said change in shape occurs at a predetermined point in the rotation of said primary supporting means.

7. Apparatus as set forth in claim 6 wherein said primary supporting means comprises means defining a substantially circular surface on which said web-like member normally rests, and wherein said means for collapsing a portion of said primary supporting means comprises a portion of said surface defining means being movable with respect to the rest of said surface defining means to a position inwardly of said substantially circular surface.

8. Apparatus as set forth in claim 7 wherein said auxiliary supporting means comprises means located within said surface defining means and movable from said location to a position beyond the normal position of said portion of said surface defining means for supporting the portion of said web-like member overlying said portion of said surface defining means in a flat configuration.

9. In a photocopy machine which utilizes a web photoconductor for making copies of a document by exposing a portion of the photoconductor to a full frame, short duration, high illumination intensity image of the document to produce an electrostatic latent image of the document on the photoconductor which is developed by the application of developer material which in turn is transferred to copy paper, apparatus for handling the photoconductor web comprising:

a. a hollow drum mounted in the photocopy machine for rotation therein to bring successive portions of the drum surface into operative relationship with copying instrumentalities arranged in a substantially circular path around the drum surface;
b. a photoconductor web supported by and extending around the drum surface;
c. first means comprising a pair of arcuate doors formed as a plurality of door segments spaced apart along the longitudinal axis of said drum so as to define slots between each adjacent pair of door segments and being movably mounted on said drum and normally positioned to define a portion of said drum surface and to maintain said photoconductor web in a circular configuration, said means being movable to a collapsed position where said portion of said drum surface is non-circular and having a curvature corresponding to the curvature of said drum surface, said doors being pivotally connected to said drum so as to swing inwardly relative to said drum surface thereby rendering the portion of said drum surface defined by said doors non-circular;
d. a second means movably mounted within said drum and normally positioned to be out of supporting relationship with said photoconductor web, said means being movable to an extended position in which said means supports a portion of said photoconductor web in a flat planar configuration, said second means projects through said slots when said second means has moved to said extended position to support said portion of said photoconductor in said flat planar configuration, and;
e. actuating means operable to move said first and second means simultaneously from said normal positions to said collapsed and extended positions respectively when said drum reaches a predetermined point of rotation, whereby at said point of rotation said flat portion of said photoconductor web can be exposed to a full frame, short duration, high illumination intensity image of a document.

10. Apparatus as set forth in claim 9 wherein said second means comprises a pair of support means pivotally mounted within said drum to pivot in opposite directions so as to extend through said slots and beyond the drum surface defined by said doors when said doors are in their normal positions so as to support said portion of said photoconductor web in said flat planar configuration.

11. Apparatus as set forth in claim 10 wherein said each support means comprises a plurality of guide rollers sized to fit through said slots, a supporting arm for each guide roller, a common shaft mounted within said drum on which all of said supporting arms are pivotably mounted, and means interconnecting all of the supporting arms for each support means for movement as a unit whereby the photoconductor web is supported evenly across its width.

12. In a photocopy machine which utilizes a web photoconductor for making copies of a document by exposing a portion of the photoconductor to a full frame, short duration, high illumination intensity image of the document to produce an electrostatic latent image of the document on the photoconductor which is developed by the application of developer material which in turn is transferred to copy paper, apparatus for handling the photoconductor web comprising:

a. a hollow drum mounted in the photocopy machine for rotation therein to bring successive portions of the drum surface into operative relationship with copying instrumentalities arranged in a substantially circular path around the drum surface;

b. a single photoconductor web supported by and extending around the drum surface;

c. a supply means and take-up means for said photoconductor web mounted for rotation within said drum;

d. a slit means formed in said drum in closely spaced relationship through which said photoconductor extends from said supply means to said drum surface and from said drum surface to said take-up means after said photoconductor web passes around said drum surface;

e. first means movably mounted on said drum and normally positioned to define a portion of said drum surface and to maintain said photoconductor web in a circular configuration, said first means being movable to a collapsed position in which said portion of said drum surface is non-circular;

f. second means movably mounted within said drum and normally positioned to be out of supporting relationship with said photoconductor web, said second means being movable to an extended position in which said second means supports a portion of said photoconductor web in a flat planar configuration, and g. means operatively interconnecting said first and second movably mounted means for causing simultaneous movement of said first and second movably mounted means from said normal positions to said collapsed and extended positions respectively and back to said normal positions, and h. single actuating means operable on one of said first and second movably mounted means for causing said simultaneous movement of said first and second movably mounted means when said drum reaches a predetermined point of rotation during each revolution of said drum.

13. Apparatus for changing the shape of a thin web-like flexible member while said member is rotating in a substantially circular path comprising:

a. primary means for supporting said web-like member in a substantially circular configuration and for rotating said member about a central axis;

b. supply means and take-up means for said web-like member mounted for rotation within said primary supporting means;

c. slit means formed in said primary supporting means in closely spaced relationship through which said web-like member extends from said supply means to said take-up means after said web-like member passes around said primary supporting means;

d. means for collapsing a portion of said primary supporting means so as to be out of supporting relationship with said web-like member;

e. auxiliary supporting means disposed within said primary supporting means at the locations where said portion of said primary supporting means collapses, said auxiliary supporting means normally being disposed in a position where said auxiliary supporting means is out of supporting relationship with said web-like member;

f. means for moving said auxiliary supporting means to a position where said auxiliary supporting means is in supporting relationship with said web-like member so as to support said web-like member in a flat configuration when said portion of said primary supporting means is collapsed;

g. means operatively interconnecting said primary and auxiliary supporting means for causing simultaneous movement of said primary and auxiliary supporting means from said normal positions to said collapsed and flat supporting positions respectively and back to said normal positions, and h. single actuating means operable on one of said primary and auxiliary supporting means for causing said simultaneous movement of said primary and auxiliary supporting means when said primary supporting means reaches a predetermined point of rotation during each revolution of said primary supporting means.

* * * * *